US005192926A

United States Patent [19]

Sogo et al.

[11] Patent Number: 5,192,926

[45] Date of Patent: Mar. 9, 1993

[54] DIELECTRIC FILTER WITH ATTENUATION POLES

[75] Inventors: Hiroyuki Sogo, Otawara; Yasuyuki Kondo, Nasu; Kazuhisa Yamazaki, Hamamatsu, all of Japan

[73] Assignees: Fujitsu Limited, Kawasaki; Fuji Electrochemical Co., Ltd., Tokyo, both of Japan

[21] Appl. No.: 642,351

[22] Filed: Jan. 17, 1991

[30] Foreign Application Priority Data

Jan. 17, 1990 [JP] Japan ..... 2-006378

[51] Int. Cl.[5] ..... H01P 1/203

[52] U.S. Cl. ..... 333/204; 333/205

[58] Field of Search ..... 333/202-207, 333/208, 219, 222, 235, 161, 246, 238

[56] References Cited

U.S. PATENT DOCUMENTS

| | | | |
|---|---|---|---|
| 4,418,324 | 11/1983 | Higgins | 333/204 |
| 4,423,396 | 12/1983 | Makimoto et al. | 333/204 |
| 4,703,291 | 10/1987 | Nishikawa et al. | 333/204 X |
| 4,757,286 | 7/1988 | Konishi et al. | 333/204 |

FOREIGN PATENT DOCUMENTS

| | | | |
|---|---|---|---|
| 2210225 | 6/1989 | European Pat. Off. . | |
| 3113452 | 11/1982 | Fed. Rep. of Germany | 333/161 |
| 0127527 | 6/1989 | Fed. Rep. of Germany . | |
| 58-166803 | 10/1983 | Japan . | |
| 0161902 | 9/1984 | Japan | 333/208 |
| 0015401 | 1/1986 | Japan | 333/206 |
| 0243402 | 10/1987 | Japan | 333/202 |

OTHER PUBLICATIONS

1988 IEEE International Symposium on Circuits and Systems, Jun. 7-9, 1988, Espoo, FI, IEEE, New York, U.S., 1988, "Suspended Substrate Strip Line Filters with Flat Delay", I. H. Zabalawi, pp. 2777-2780.

Frequenz, vol. 34, No. 3, Mar. 1980, Berlin, Del., "Cauerparameter-Bandpasse in Mikrostreifenleiter-Technik", H. Fechner, pp. 78-89.

*Primary Examiner*—Paul M. Dzierzynski
*Assistant Examiner*—Seung Ham
*Attorney, Agent, or Firm*—Staas & Halsey

[57] ABSTRACT

A first dielectric block or blocks have a cut out portion and the cut out space is filled with a second dielectric block. A bypass pattern is formed on the second dielectric block and is capacitively coupled with two resonance elements formed on the first dielectric block or blocks. the dielectric filter is compact, and the position and intensity of attenuation poles can be freely designed and easily adjusted.

19 Claims, 4 Drawing Sheets

DIELECTRIC FILTER WITH ATTENUATION POLES

1. Field of the Invention

The present invention relates to a dielectric filter which is provided with attenuation poles to improve its passband characteristics.

2. Description of the Related Art

A λ/4 resonance coaxial type filter comprising a plurality of coaxial resonance conductors which are successively coupled with each other, is used as a microwave bandpass filter.

This type of dielectric filter has shortcomings in that the manufacturing process therefor is complex and an improvement in frequency accuracy is not easy because the frequency accuracy is dominantly determined by dimensional accuracy of a dielectric block, such as ceramics.

A so-called tri-plate type dielectric filter has been proposed to overcome the above shortcomings. In the tri-plate type dielectric filter, a plurality of resonance conductors are combined into a conductor pattern having a plurality of resonance elements. The conductor pattern is interposed between two dielectric plates, outside which metallization is applied.

Also, a dielectric filter, wherein a conductor pattern having a plurality of resonance elements is formed on one surface of a dielectric block and the other surfaces of the dielectric block are metallized, has been proposed. This filter corresponds to one of two fragments formed by cutting the tri-plate type dielectric filter along its plane of symmetry.

It is known to form attenuation poles in the frequency characteristic curve of a filter having successively coupled resonance elements, in order to sharpen the curve or to eliminate specific frequency components such as a leakage of a local oscillation frequency.

The poles are formed by providing a bypass in which phase and amplitude of a signal are varied, so that the junction phase difference for the specific frequency becomes 180° and attenuation factors for the specific frequency are identical.

For the former tri-plate type dielectric filter, forming of the attenuation poles is not known. For the latter type filter, attenuation poles can be formed by coupling two resonance elements through a coaxial cable having a specific length.

This construction makes the filter size large because a pattern for connecting the cable is required, and this makes the size of a casing for the filter large because space for the cable is required, as described in Japanese Unexamined Patent Publication (Kokai) No. 58-166803.

A dielectric filter with attenuation poles, wherein the above shortcomings are overcome, is disclosed in the above publication. The filter comprises two dielectric filter plates fixed to each other back to back. Two holes are provided for coupling between the resonance elements on the different dielectric filter plates. One of the two holes provides part of a main transmission path and the other hole provides the bypass.

This structure makes the dielectric filter unit compact, but the range where phase shift and bypass attenuation factor can be varied is so narrow that the position and height of the poles cannot be freely designed, and adjustment of the poles after assembly is not easy.

SUMMARY OF THE INVENTION

It is an object of the present invention to provide a compact dielectric filter with attenuation poles, wherein the position and intensity of the attenuation poles can be freely designed and easily adjusted after assembly.

In accordance with the present invention there is provided a dielectric filter with attenuation poles comprising first dielectric means, a conductor coating partially covering the surfaces of the first dielectric means, and a first conductor pattern having a plurality of projecting portions which provides a plurality of resonance elements for a dielectric resonator having a plurality of stages, cooperating with the first dielectric means and the conductor coating, characterized in that the dielectric filter further comprises second dielectric means, and a second conductor pattern formed on the second dielectric means and coupled with at least two resonance elements.

DESCRIPTION OF THE PREFERRED EMBODIMENT

Figure 1:
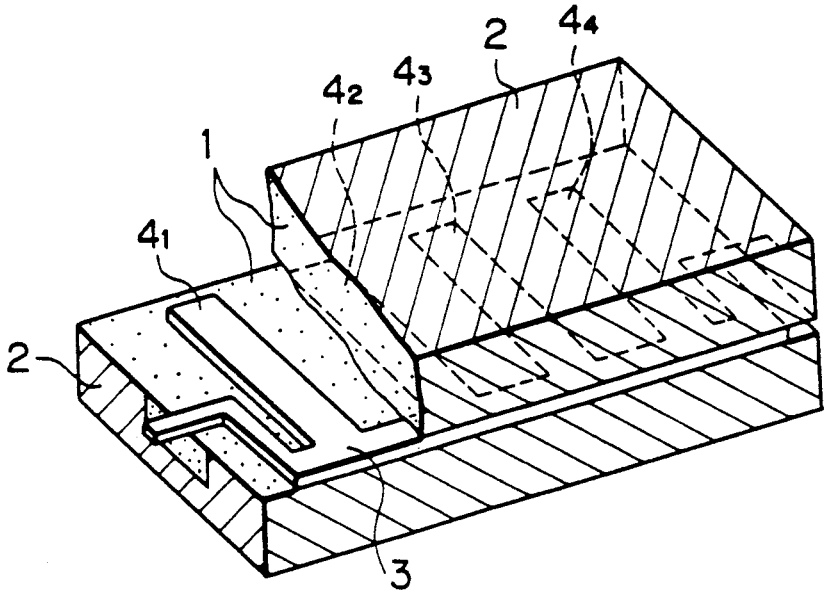
Fig. 1 PRIOR ART
FIG. 1 is a partially cutaway perspective view of a tri-plate type dielectric filter.

FIG. 1 shows a structure of the aforementioned tri-plate type dielectric filter. A conductor pattern 3 has four resonance elements $\mathbf{4}_1$ to $\mathbf{4}_4$, and the conductor pattern 3 is interposed between two dielectric blocks 1. Conductor metallization 2 (denoted by hatching) is applied on the outer surfaces of the dielectric blocks 1.

Figure 2:
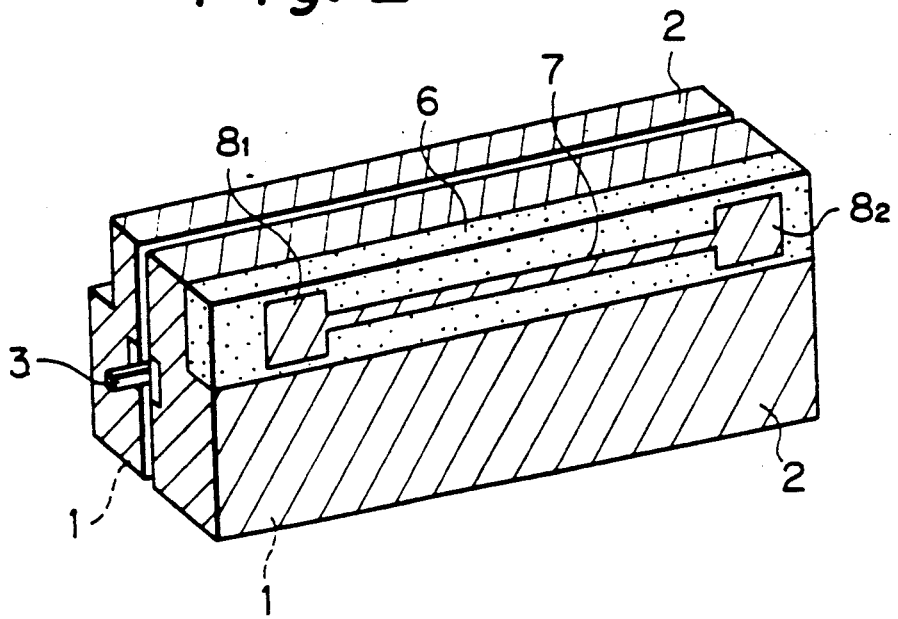
FIG. 2 is a perspective view of a dielectric filter with attenuation poles derived from the dielectric filter shown in FIG. 1, according to the first embodiment of the present invention.

FIG. 2 shows a tri-plate type dielectric filter with attenuation poles which is derived from the dielectric filter shown in FIG. 1, according to the first embodiment of the present invention. A conductor pattern 3 has four resonance elements $\mathbf{4}_1$ to $\mathbf{4}_4$ (not shown; cf. FIG. 1) between two dielectric blocks 1. The dielectric blocks 1 are cut out along upper edges, and one of the cut out spaces is filled with another dielectric block 6. A conductor pattern 7 to provide a bypass is formed on the dielectric block 6. The conductor pattern 7 has two pads $\mathbf{8}_1$ and $\mathbf{8}_2$ on both of its ends. The pads $\mathbf{8}_1$ and $\mathbf{8}_2$ are capacitively coupled with the resonance elements $\mathbf{4}_1$ and $\mathbf{4}_4$ (cf. FIG. 1), respectively.

Figure 3:
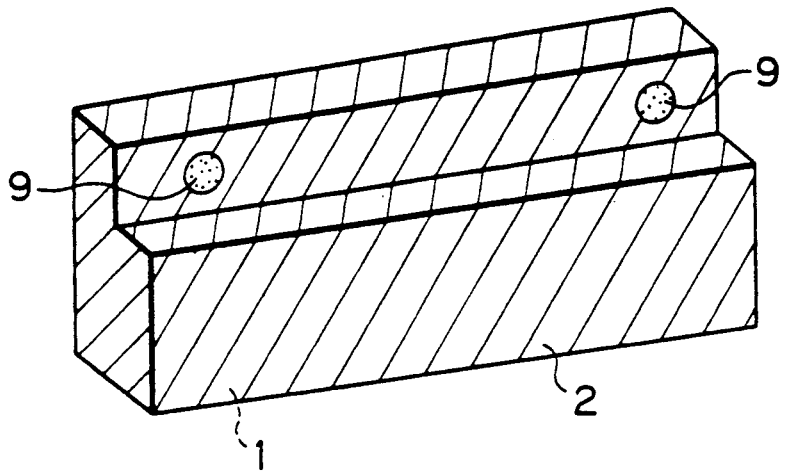
FIG. 3 is a perspective view of one of the dielectric blocks of the dielectric filter shown in FIG. 2.

FIG. 3 shows one of the dielectric blocks 1, which engages with the dielectric block 6. Conductor metallization is also applied on the surface of the cut out portion, except for circular portions 9 between resonance elements $4_1$ and $4_4$ and pads $8_1$ and $8_2$ which are coupled with each other. The circular portions 9 enable capacitive coupling between the resonance elements $4_1$ and $4_2$ and pads $8_1$ and $8_2$, respectively, to provide the bypass.

Figure 4:
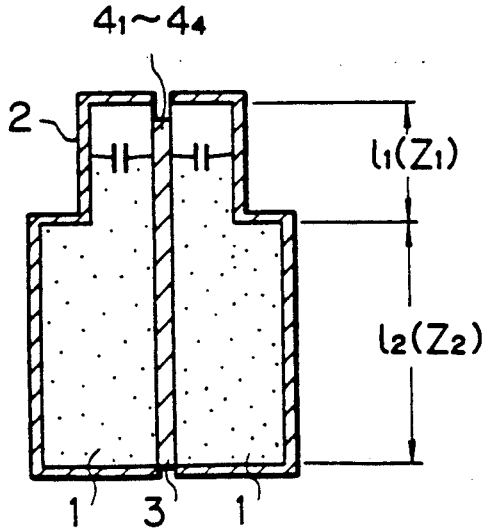
FIG. 4 is a cross-sectional view of dielectric blocks for explaining additional merit of the dielectric filter shown in FIG. 2.

FIG. 4 is a cross-sectional view of the dielectric filter shown in FIG. 2, except the dielectric block 6, to explain additional merit derived from its shape.

As the dielectric blocks 1 are cut out in an upper portion, the distances between the upper portion of the resonance elements $4_1$ to $4_4$ and conductor coatings 2 become short, so that load capacities are formed therein. The load capacities lower resonance frequencies of the resonance elements. As a result, the height of the filter $(1_1+1_2)$ can be lowered.

Additionally, as a difference in thickness is formed, coaxial impedance is divided into $Z_1$ and $Z_2$, so that an effect in which harmonic frequencies are shifted, is obtained.

Figure 5:
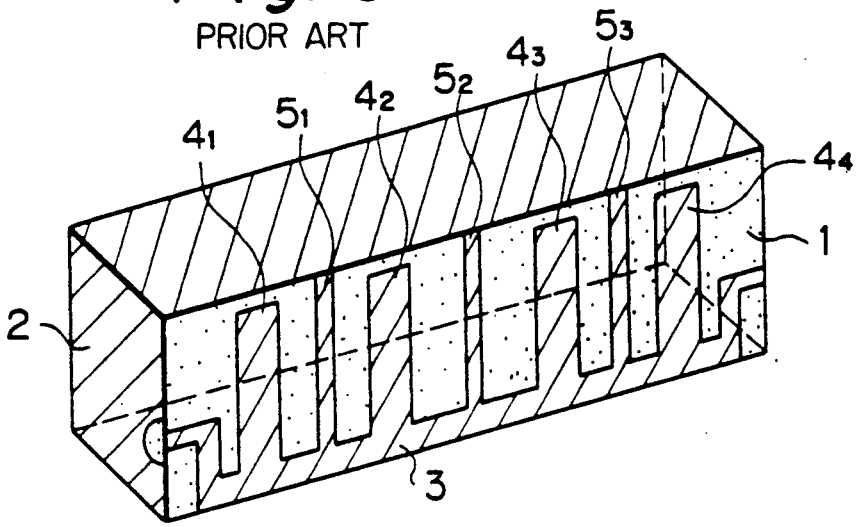
Fig. 5 PRIOR ART
FIG. 5 is a perspective view of another prior dielectric filter.

FIG. 5 shows a structure of the aforementioned second type of dielectric filter wherein a conductor pattern 3 is formed on one surface of a dielectric block 1 and the other surfaces are metallized (2) The conductor pattern 3 has four resonance elements $4_1$ to $4_4$ and three strips $5_1$ to $5_3$ which reach the upper surface. The strips $5_1$ to $5_3$ are provided to vary coupling intensity between neighboring resonance elements.

Figure 6:
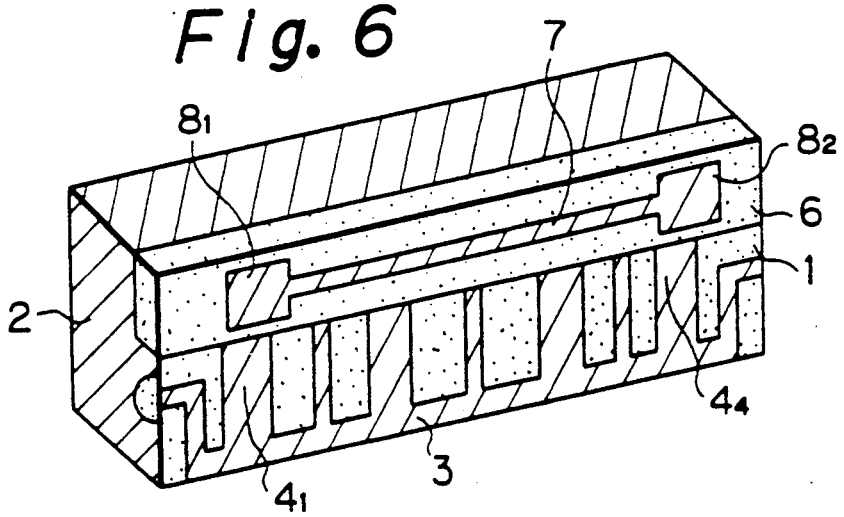
FIG. 6 is a perspective view of a dielectric filter with attenuation poles derived from the dielectric filter shown in FIG. 5, according to the second embodiment of the present invention.

FIG. 6 shows a dielectric filter derived from the dielectric filter shown in FIG. 5, according to the second embodiment of the present invention.

A dielectric block 1 is cut out along upper edges, and the cut out space is filled with another dielectric block 6. A conductor pattern 7 is formed on the dielectric block 6 to provide a bypass. The conductor pattern 7 has two pads $8_1$ and $8_2$ on both of its ends. The pads $8_1$ and $8_2$ are capacitively coupled with the resonance elements $4_1$ and $4_4$, respectively.

Figure 7:
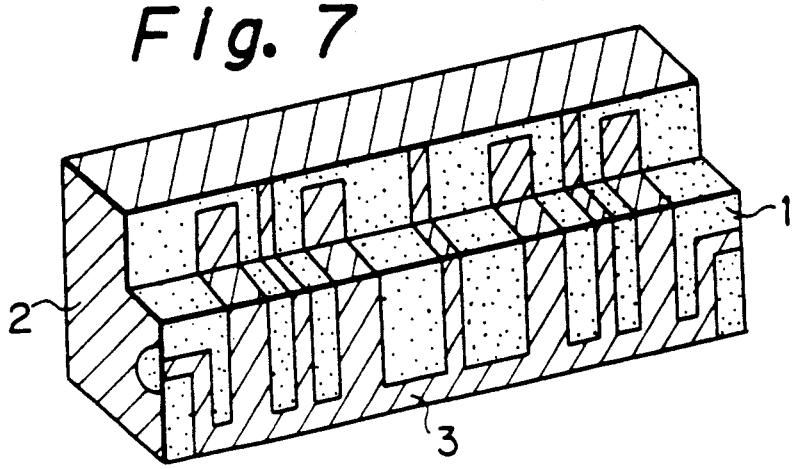
FIG. 7 is a perspective view of a dielectric block of the dielectric filter shown in FIG. 6.

FIG. 7 shows the dielectric block 1 shown in FIG. 6. A folded pattern 3 is formed on a folded or stepped surface of the dielectric block 1, and conductor metallization is applied on the other surfaces of the dielectric block 1.

Though in the example shown in FIG. 6, a cut out portion is formed on the pattern side, the cut out portion may be formed on the opposite side. In this case two holes to enable capacitive coupling must be formed, as shown in FIG. 3.

FIGS. 8A to 8G show various bypass patterns for use in the dielectric filter with attenuation poles shown in FIGS. 2 and 6.

Figure 8A:
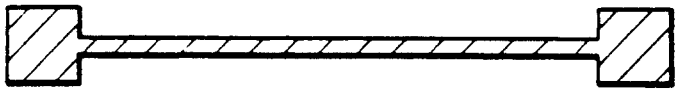
FIGS. 8A to 8G are plane views of various bypass patterns, according to the present invention.
Figure 8B:
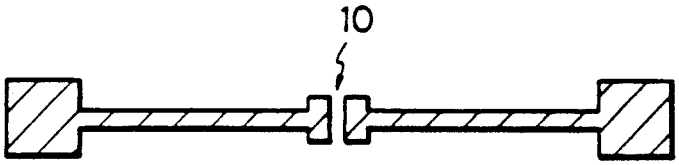

A bypass pattern shown in FIG. 8B comprises a capacitively coupled portion 10. Intensity of the coupling in portion 10 mainly affects the bypass attenuation factor. Therefore, the bypass attenuation factor can be designed by adequately determining a shape of the portion 10, and can be adjusted by altering the shape after assembly.

Figure 8C:
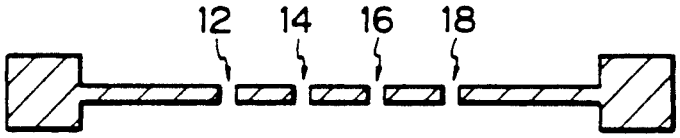

A bypass pattern shown in FIG. 8C comprises a plurality of capacitively coupled portions 12, 14, 16, and 18.

Figure 8D:
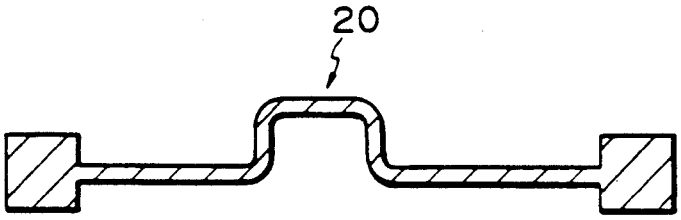

A bypass pattern shown in FIG. 8D comprises a bent portion 20. As the length of the bent portion 20 mainly affects the quantity of phase shift in the bypass, the quantity of the phase shift can be designed by adequately determining the length of the bent portion 20.

Figure 8E:
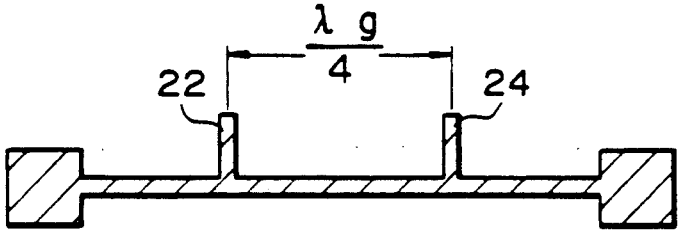

A bypass pattern shown in FIG. 8E comprises two open stubs 22, 24 separated from each other by $\lambda g/4$. As the effective length of the bypass depends on the length of the open stubs 22, 24, the amount of the phase shift can be designed by adequately determining the length of the open stubs 22, 24, and can be adjusted by altering the length of the open stubs 22, 24 after assembly.

Figure 8F:
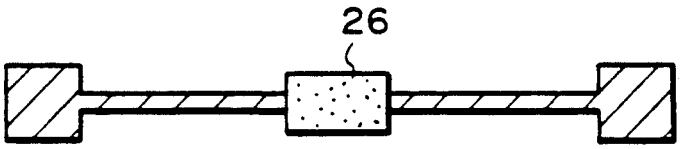

In FIG. 8F, a dielectric plate 26 is put on the bypass pattern, in order to increase an effective dielectric constant around the bypass pattern. The quantity of the phase shift can be altered by altering an area of the dielectric plate 26.

Figure 8G:
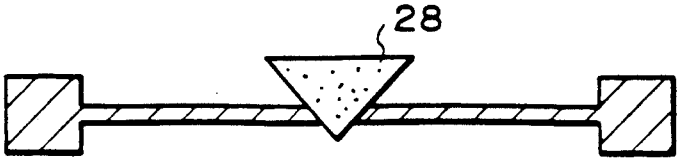

In FIG. 8G, a tapered dielectric plate 28 is put on the bypass pattern. The effective dielectric constant around the bypass pattern can be altered by moving the dielectric plate 28 up or down.

What is claimed is:

1. A dielectric filter having attenuation poles and having a plurality of resonance elements, comprising:

first dielectric means having surfaces and having a shape which is partially cut out to provide a cut out space;

a conductor coating partially covering the surfaces of said first dielectric means;

a first conductor pattern on a portion of said first dielectric means which is not covered by said conductor coating, said first conductor pattern having a plurality of projecting portions which provide all of said plurality of resonance elements, said first conductor pattern cooperating with said first dielectric means and said conductor coating to form a dielectric resonator having a plurality of stages;

second dielectric means which fills the cut out space of said first dielectric means; and a second conductor pattern formed on said second dielectric means and coupled with at least two of said plurality of resonance elements.

2. A dielectric filter with attenuation poles as claimed in claim 1, wherein said first dielectric means comprises a dielectric block, wherein said first conductor pattern is formed on one side of said dielectric block, and wherein said conductor coating covers the other sides of said dielectric block.

3. A dielectric filter with attenuation poles as claimed in claim 1, wherein said second conductor pattern has at least one capacitively coupled portion.

4. A dielectric filter with attenuation poles as claimed in claim 1, wherein said second conductor pattern has at least one bent portion.

5. A dielectric filter with attenuation poles as claimed in claim 1, wherein said second conductor pattern has two separated stubs.

6. A dielectric filter with attenuation poles as claimed in claim 1, further comprising a dielectric plate on said second conductor pattern.

7. A dielectric filter with attenuation poles as claimed in claim 6, wherein said dielectric plate is tapered.

8. A dielectric filter comprising:

a first volume of dielectric material having a plurality of surfaces, at least one of said plurality of surfaces being an indented surface;

a first conductor pattern abutting at least one of said plurality of surfaces, said first conductor pattern including a plurality of resonance portions;

a conductor coating on at least portions of the plurality of surfaces of said first dielectric volume, said first conductor pattern, said first volume of dielectric material and said conductor coating forming a dielectric resonator;

a second volume of dielectric material in said indented surface of said first volume of dielectric material; and a second conductor pattern on said second volume of dielectric material and coupled to at least two of said plurality of resonance portions of said first conductor pattern.

9. A dielectric filter as set forth in claim 8, wherein the coupling between said second conductor pattern and said at least two of said plurality of resonance portions of said first conductor pattern, comprises capacitive coupling.

10. A dielectric filter as set forth in claim 8, wherein said first and second volumes of dielectric material comprise first and second dielectric blocks, respectively.

11. A dielectric filter as set forth in claim 10, wherein said indented surface comprises a cut-out portion in said first dielectric block.

12. A dielectric filter as set forth in claim 8, wherein said first conductor pattern is on said indented surface.

13. A dielectric filter as set forth in claim 8, wherein said second conductor pattern has at least one capacitively coupled portion.

14. A dielectric filter as set forth in claim 8, wherein said second conductor pattern has at least one bent portion.

15. A dielectric filter as set forth in claim 8, wherein said second conductor pattern has first and second separated stubs.

16. A dielectric filter as set forth in claim 8, further comprising a dielectric plate on said second conductor pattern.

17. A dielectric filter as set forth in claim 16, wherein said dielectric plate is tapered.

18. A bandpass filter, comprising:

a dielectric filter including a first volume of dielectric material having surfaces including an indented surface, and first and second resonance elements disposed on said first volume of dielectric material;

a conductor coating partially covering the surfaces of said first volume of dielectric material;

a second volume of dielectric material in said indented surface of said first volume of dielectric material, said second volume of dielectric material having a surface; and a conductor pattern on said surface of said second volume of dielectric material, said conductor pattern being coupled to said first and second resonance elements of said dielectric filter.

19. A dielectric filter having attenuation poles and having a plurality of resonance elements, comprising:

first and second dielectric blocks having inner and outer surfaces and at least one of said first and second dielectric blocks having a shape which is partially cut out to provide a cut out space;

a first conductor pattern interposed between the inner surfaces of said first and second dielectric blocks, said first conductor pattern having a plurality of projecting portions which provide all of said plurality of resonance elements;

a conductor coating covering the outer surfaces of said first and second dielectric blocks except for first and second openings, said first conductor pattern cooperating with said first and second dielectric blocks and said conductor coating to form a dielectric resonator having a plurality of stages;

dielectric means which fills the cut out space of said at least one of said first and second dielectric blocks; and a second conductor pattern formed on said dielectric means and coupled with at least two of said plurality of resonance elements, the first and second openings in said conductor coating enabling capacitive coupling between said second conductor pattern and said resonance elements.

* * * * *